United States Patent [19]

Gruner et al.

[11] 4,445,014

[45] Apr. 24, 1984

[54] HIGH-VOLTAGE DISCONNECT SWITCH

[75] Inventors: Werner Gruner; Sreenivasan S. Kumar, both of Berlin, Fed. Rep. of Germany

[73] Assignee: Siemens Aktiengesellschaft, Munich, Fed. Rep. of Germany

[21] Appl. No.: 383,136

[22] Filed: May 28, 1982

[30] Foreign Application Priority Data

Jun. 21, 1981 [DE] Fed. Rep. of Germany ..... 3122442

[51] Int. Cl.[3] ..... H01H 9/38

[52] U.S. Cl. ..... 200/78; 200/146 R; 200/154

[58] Field of Search ..... 200/154, 74, 48 R, 146 A, 200/146 R, 78

[56] References Cited

U.S. PATENT DOCUMENTS

| | | | |
|---|---|---|---|
| 4,271,339 | 6/1981 | Meister et al. | 200/146 R X |
| 4,296,288 | 10/1981 | Yanabu et al. | 200/146 R |
| 4,348,561 | 9/1982 | McKelvy | 200/78 X |

FOREIGN PATENT DOCUMENTS

| | | | |
|---|---|---|---|
| 1615898 | 7/1970 | Fed. Rep. of Germany . | |
| 1261626 | 4/1961 | France | 200/146 R |

*Primary Examiner*—John W. Shepperd
*Assistant Examiner*—Renee S. Kidorf
*Attorney, Agent, or Firm*—Kenyon & Kenyon

[57] ABSTRACT

A disconnect switch for high-voltage installations is disclosed. The switch includes a pair of hollow contacts, one of which is movable, disposed in a grounded metallic housing filled with compressed gas. A spring-loaded contact-breaking pin is provided in one of the hollow contacts. The pin is provided at its free end with a recess which is engaged in the "on" position of the switch by a ratchet device pivotally disposed in the other contact. During movement of the movable contact toward the "off" position of the switch, the contact-breaking pin remains in contact with the ratchet device. The mechanically controlled ratchet device releases the contact-breaking pin at a given position of the movable contact. The contact-breaking pin is then returned by its spring into its hollow contact with a velocity greater than that of the movable contact. Any arc which may be generated between the ratchet device and the contact-breaking pin is thereby quickly quenched even though the disconnect switch is driven at a slow speed.

5 Claims, 6 Drawing Figures

HIGH-VOLTAGE DISCONNECT SWITCH

BACKGROUND OF THE INVENTION

The present invention relates to a high-voltage disconnect switch, particularly to a high-voltage disconnect switch disposed in a grounded housing filled with an insulating medium of high dielectric strength.

DE-AS No. 16 15 898 discloses a high-voltage disconnect switch disposed in a metallic housing filled with $SF_6$ gas. Both contacts of the disconnect switch are moved by a drive to bring them into engagement with each other in one end position of the drive, and to separate them in the other end position of the drive by a gap large enough to effect a disconnect or "off" condition of the switch for a given voltage. Each contact is hollow and a contact-breaking pin is disposed in one contact and is urged in the "on" direction by a spring. A pumping device is provided in the contact in which the pin is disposed are retards movement of the contact-breaking pin to thereby delay its movement relative to the contact in which it is disposed as the switch is being switched on. After the contact-breaking pin has reached the other contact in the "on" position of the switch, the spring continues to urge the contact-breaking pin in the "on" direction and continues to do so as the contacts are started in motion to the "off" position. Since the pumping device is disposed in the contact, it is taken along therewith as the contact moves towards the off position and pumps insulating medium, particularly $SF_6$, through the hollow contact to the tip of the contact-breaking pin so that upon the release of the other contact by the contact-breaking pin, any arc which may occur is quickly quenched by being flushed with the insulating medium. The disconnect switch disclosed in this German patent publication is therefore capable of also switching certain low loads.

Metal-encapsulated, compressed gas-insulated disconnect switches are generally equipped, for economic reasons, with a relatively slow drive for moving the contacts. Therefore, if possible, the switches are not switched under load because, if an arc occurs, the danger exists, due to the slow disconnect motion of the contacts and particularly in the case of higher voltages, of the arc travelling off the contacts and jumping to the grounded metal encapsulation, thereby forming a short to ground.

OBJECT AND SUMMARY OF THE INVENTION

It is an object of the present invention to provide a disconnect switch, particularly a metal-encapsulated, compressed-gas insulated disconnect switch, in which the relative motion between the contacts is slow and which can withstand arcing without damage, particularly arcs occurring, for example, when transformers are switched under no load conditions.

The above and other objects are achieved according to the invention by providing a disconnect switch which includes contact breaking means which are moved at a greater velocity than the relative velocity between the contacts themselves at least during a contact breaking operation or sequence.

According to an embodiment of the invention, the contacts are hollow and each includes an element disposed in the respective contact which is movable relative to the respective contact. At least one and preferably both of said elements are movable at a velocity which is greater than the relative velocity between the contacts themselves, at least one of which is movable. The elements include means for engaging each other and means for releasing each other when the contacts are spaced by a predetermined distance.

According to a disclosed embodiment, each hollow contact is surrounded by a field electrode, a pin is disposed in one hollow contact and a ratchet device is disposed in the other hollow contact. The pin is provided at its free end with a recess which is engaged by the ratchet device disposed in the other contact in the "on" position of the switch. The ratchet device is mechanically controlled and releases the pin when the contacts are separated by a predetermined distance. The pin is spring-loaded and is retracted into the hollow contact upon release by the ratchet device at a velocity greater than the relative velocity between the contacts, at least one of which is movable. In the disclosed embodiments, only one of the contacts is movable.

By providing a mechanically controlled ratchet device, a firm connection of the ratchet device and the pin can be obtained in the "on" position of the switch. This firm connection is maintained at the start of the disconnect sequence so that electrical contact is not interrupted until the relative movement of the contacts spaces the contacts by a sufficiently large gap at which time the ratchet device releases the pin. During the disconnect sequence, the engaged pin and the ratchet device are moved relative to the respective contact in which each are disposed to load the respective springs as at least one of the contacts is moved. Then, the ratchet device releases the pin at a predetermined time in the disconnect sequence, i.e. in a predetermined relative position of the contacts, and the spring returns the pin into its hollow contact with a velocity greater than the relative velocity between the contacts. If an interruption arc occurs, for example, in the presence of a low load, the arc will be quickly quenched because of the high velocity at which the pin and the ratchet device are pulled apart and will not have the opportunity to jump to the grounded encapsulation.

Since the pin and the ratchet device are in the interior of the respective field electrode in the rest position, i.e. in the "off" position, of the switch, the electric field in the switching gap is not changed thereby.

It is particularly advantageous to provide a ratchet device having an adjustable stop in the interior of its associated field electrode for locking and releasing the ratchet device. Thereby, the position at which the ratchet device releases the movable contact can be freely selected and is adjustable.

The ratchet device can advantageously be chosen as an angular lever which can move about a fulcrum or a pair of pivoted opposing tongs which can provide better mechanical engagement of the pin.

The above and other objects, features, aspects and advantages of the invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
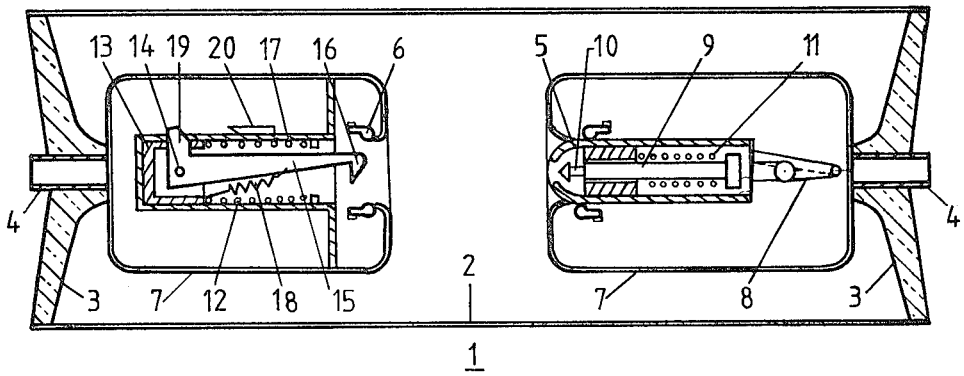
FIG. 1 is a schematic cross-sectional view of a disconnect switch according to the invention in the disconnect condition thereof.

In the embodiment depicted in FIGS. 1–4, the disconnect switch 1 is disposed in a tubular, metallic, grounded housing 2 which is terminated in end faces having conical feedthrough insulators 3 therethrough, each of which supports a centrally arranged tubular conductor 4. The housing 2 is filled with pressurized $SF_6$ gas.

In order to equalize the electric field between the grounded housing 2 and the contacts 5, 6, the contacts are disposed in and surrounded by hollow, cylindrical, shielding field electrodes 7. Each contact 5, 6 is also hollow. Contact 5 is movable and its drive 8 is arranged in the interior of the field electrode 7. In the interior of the hollow movable contact 5 is arranged a contact-breaking pin 9 having its free end provided with a recess 10 formed by a smaller diameter portion thereof. The contact-breaking pin 9 is urged to its end or rest position toward the "off" position of the switch by a spring 11. In the rest of the "off" position of the switch shown in FIG. 1, the pin 9 is disposed completely within the movable contact 5 and does not protrude therefrom.

Contact 6 is fixed and is disposed in the interior of the other field electrode 7. A cylinder 12 is provided in the interior of the field electrode in which fixed contact 6 is disposed and a piston 13 is slidably disposed in the cylinder. The piston 13 carries a ratchet 15 which is pivotally supported by a bearing 14. The ratchet 15 comprises an angled lever which terminates in a hook 16. The ratchet 15 is also urged to its end or "off" position by a spring 17 toward the "off" position of the switch so that it does not protrude beyond the fixed contact 6 in the rest or "off" position of the switch shown in FIG. 1. A return spring 18 is connected between the piston 13 and the ratchet lever to urge the lever away from a pivoted position thereof. Spring 18 retracts the ratchet lever into its rest position shown in FIG. 1 after it has been pivoted. A short extension of the ratchet lever in the form of lever arm 19 adjacent to the bearing 14 protrudes through a slot in the cylinder 12. Disposed along the travel of the lever arm 19 in the slot is an adjustable and lockable stop 20 which engages the lever arm 19 and pivots the ratchet lever upwardly relative to FIG. 1. The lever arm and the stop are cammed to improve the pivoting action.

Figure 2:
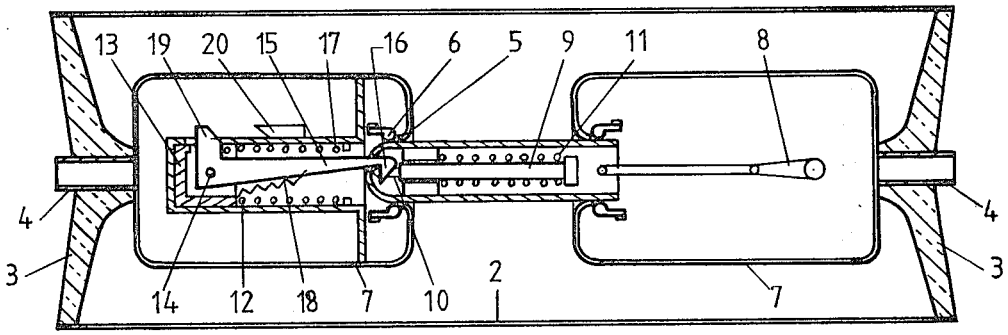
FIG. 2 is a schematic view similar to that of FIG. 1 of the switch of FIG. 1 in the connect condition thereof.

The "off" position or disconnect condition of the disconnect switch 1 is, as indicated above, depicted in FIG. 1 in which the contact-breaking pin 9 is within the movable contact 5 and the ratchet 15 is within the fixed contact 12 in their rest positions. The "on" position or connect condition of the disconnect switch 1 is depicted in FIG. 2.

In the "on" position, the movable contact 5 is engaged with the fixed contact 6. The ratchet 15 is in its unpivoted rest position but protrudes into the hollow movable contact 5 and engages the recess 10 of the pin. The ratchet lever is provided with a hook 16 for engaging the recess 10 of the pin. The hook 16 includes a forward cammed portion and the forward end of the tip of the pin is cammed. The forward cammed portion of the hook cooperates with the cammed portion of the pin to cam the ratchet lever and pivot it so the hook clears the tip of the pin and is engaged in the recess as the pin is moved towards the ratchet. In the "on" position of FIG. 2, in addition to the main current path from the conductor 4 via the movable contact 5, the fixed contact 6 and the field electrodes 7 to the conductor 4, an auxiliary current path via the contact-breaking pin 9 and the ratchet 15 is also provided.

Figure 3:
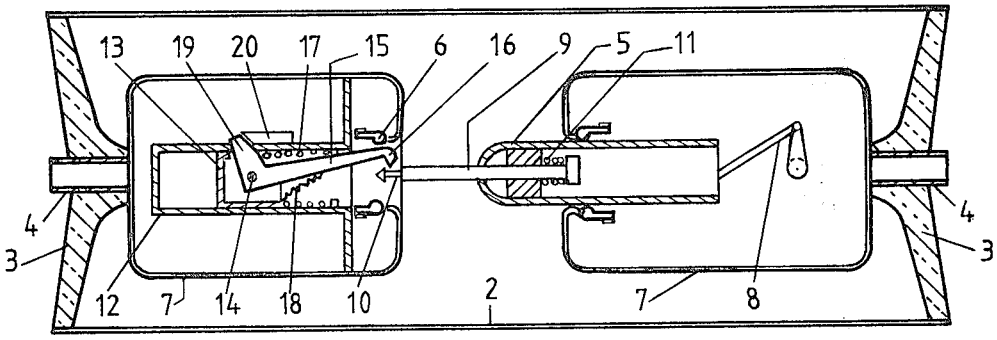
FIG. 3 is a schematic view similar to that of FIG. 1 of the switch of FIG. 1 showing the switch during a disconnect sequence thereof.
Figure 4:
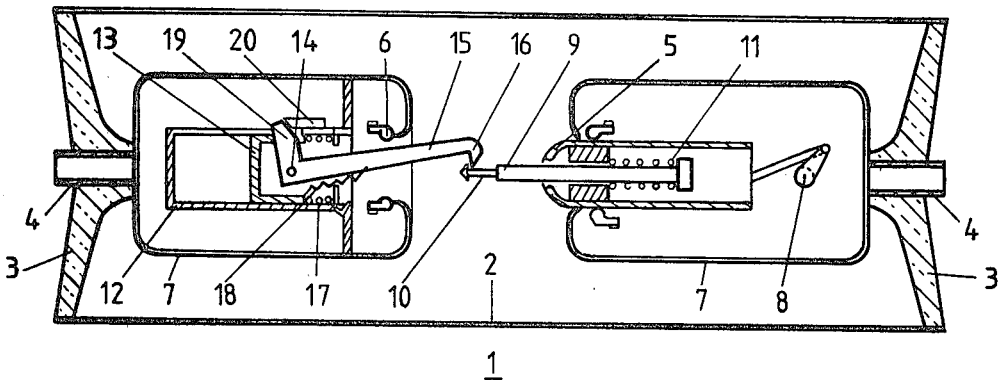
FIG. 4 is a schematic view similar to that of FIG. 3 showing the switch in another position during the disconnect sequence.

When the disconnect switch 1 is opened (FIGS. 3 and 4), the slow-moving drive 8 first moves the hollow movable contact 5 back a distance such that its connection to the fixed contact 6 is interrupted, as shown in FIG. 3. After a sufficiently large separating gap is produced, while the contact-breaking pin 9 remains engaged with the ratchet 15 so that current can flow through the auxiliary current path alone, the ratchet lever is disengaged from the pin to break contact altogether (FIG. 4). As the contact 5 is moved to the "off" position (FIGS. 3–4) from the "on" position of FIG. 2, the spring 11 is cocked and loads the contact-breaking pin 9 as does the spring 17 of the ratchet 15 since the ratchet lever is taken along by the contact-breaking pin 9. Upon the lever arm 19 striking the stop 20 (FIG. 4), the ratchet lever is caused to pivot whereby the hook 16 emerges from the recess 10 in the contact-breaking pin 9 and releases the pin. The cocked springs 11 and 17 cause the ratchet 15 and the contact-breaking pin 9 to move apart at several times the velocity of the movable contact 5 so that any arc that may be generated between the ratchet lever and the contact-breaking pin 9 is extinguished quickly.

The time (position) at which the contact-breaking pin 9 is released by the ratchet 15 can be determined very accurately by adjustment of the stop 20. In the position of the stop 20 shown in FIG. 3, the ratchet lever is still within the field electrode 7 as the contact 5 is being moved towards the "off" position. The ratchet 15 continues to be engaged with the pin and is drawn out of the field electrode 7 to the position shown in FIG. 4 by the contact-breaking pin 9 as the pin continues to move towards the "off" position. When the lever arm 19 engages the stop 20, the ratchet lever extends into the gap separating the contacts. The ratchet lever is then pivoted and releases the contact-breaking pin 9. The return spring 11 returns the ratchet lever to the rest position after it has been pivoted.

Figure 5:
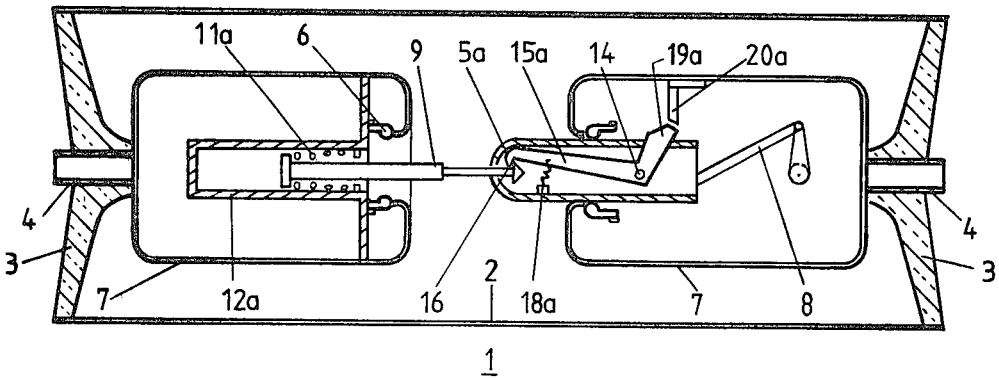
FIG. 5 is a schematic similar to that of FIG. 1 of disconnect switch according to another embodiment of the invention.

FIG. 5 shows another embodiment of the disconnect switch 1 in which the contact-breaking pin 9 and its spring 11*a* are disposed in the cylinder 12*a* the field electrode 7 of the fixed contact 6. The ratchet 15*a*, on the other hand, is disposed together with its return spring 18*a* in the interior of the movable contact 5*a*. The ratchet lever is made pivotable via bearing 14 and pivoting is actuated by engagement of the lever arm 19*a* of the ratchet lever, protruding through a slot in the hollow movable contact 5*a*, with the stop 20*a* within the field electrode 7 during the "off" motion of the switch. Thereby, the ratchet lever can release the contact-breaking pin 9, as described above.

Figure 6:
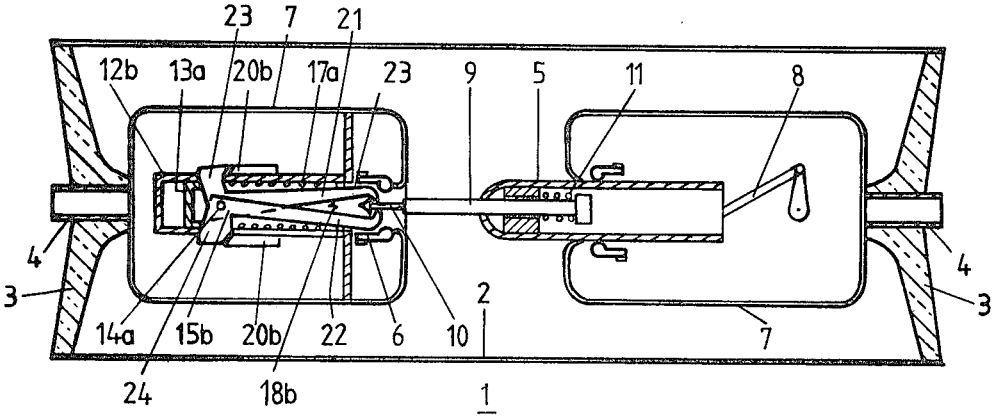
FIG. 6 is a schematic view similar to that of FIG. 1 of a disconnect switch according to still another embodiment of the invention.

In the embodiment of FIG. 6, the ratchet 15*b* is disposed within the field electrode 7 surrounding the fixed contact. The ratchet is pivotably disposed via bearing 14*a* on the piston 13*a* sliding in the cylinder 12*b* and is provided with two pivoted tong arms 21, 22, between which the return spring 18*b* is connected. The ratchet is additionally loaded by the spring 17*a*. When the disconnect switch 1 is closed, the two tong arms 21, 22 engage both sides of the recess 10 of the contact-breaking pin 9. Thereby, the mechanical connection between the contact-breaking pin 9 and the ratchet 15*b* is improved. Each tong arm 21, 22 ends in a lever extension 23, 24, which is engaged by a respective stop 20*b* to pivot a respective tong arm and release the contact-breaking pin 9.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purpose of disclosure without departing from the spirit and scope of the invention.

What is claimed is:

1. A high voltage disconnect switch comprising a grounded housing filled with an insulating medium of high dielectric strength, a pair of hollow cylindrical electrodes spaced apart in the housing, a hollow cylindrical contact disposed in each of the electrodes, at least one of the contacts being movably arranged in an electrode, a contact pin movably disposed in one of the contacts and a spring urging the contact pin to a predetermined position relative to the one contact, a ratchet device pivotally disposed in the other contact, the contact pin having a recess which is releasably engaged by the ratchet device when the movable contact is moved into contact with the other contact, means for pivoting the ratchet device causing the ratchet device to release the contact pin when the contacts are separated by a predetermined distance as the movable contact is moved away from the other contact, the spring retracting the contact pin into the hollow contact toward the predetermined position upon release thereof by the ratchet device at a velocity greater than the relative velocity between the contacts.

2. The switch according to claim 1 wherein the ratchet device is mounted on a piston which slides in a cylinder within the respective field electrode and is urged by a spring into an end position in which the ratchet device is in the interior of the electrode.

3. The switch according to claim 2 wherein an adjustable stop is disposed in the respective field electrode which engages the ratchet device to pivot it and release engagement of the pin.

4. The switch according to claim 2 wherein the ratchet device comprises a pivotally mounted lever.

5. The switch according to claim 2 wherein the ratchet device comprises a pair of cooperating tong arms, each of which is pivotally mounted.

* * * * *